US009162284B2

(12) United States Patent
Morales et al.

(10) Patent No.: US 9,162,284 B2
(45) **Date of Patent: *Oct. 20, 2015**

(54) CASTING NOZZLE

(71) Applicant: REFRACTORY INTELLECTUAL PROPERTY GMBH & CO KG, Vienna (AT)

(72) Inventors: Rodolfo Davila Morales, Cuautitlan-Izcalli (MX); Jorge Palafox-Ramos, Del Azcapotzalco (MX)

(73) Assignee: REFRACTORY INTELLECTUAL PROPERTY GMBH & CO KG, Vienna (AT)

( * ) Notice: Subject to any disclaimer, the term of this patent is extended or adjusted under 35 U.S.C. 154(b) by 155 days.

This patent is subject to a terminal disclaimer.

(21) Appl. No.: 14/055,220

(22) Filed: Oct. 16, 2013

(65) Prior Publication Data

US 2014/0042192 A1 Feb. 13, 2014

Related U.S. Application Data

(62) Division of application No. 11/886,478, filed as application No. PCT/GB2007/001878 on May 21, 2007, now Pat. No. 8,584,911.

(30) Foreign Application Priority Data

Jun. 1, 2006 (GB) ..... 0610809.6

(51) Int. Cl.
*B22D 11/10* (2006.01)
*B22D 41/50* (2006.01)

(52) U.S. Cl.
CPC ..... *B22D 41/50* (2013.01)

(58) Field of Classification Search
CPC ..... B22D 41/50
USPC ..... 222/591, 606, 607
See application file for complete search history.

(56) References Cited

U.S. PATENT DOCUMENTS 5,603,860 A 2/1997 Hohenbichler
5,944,261 A 8/1999 Heaslip et al. ..... 239/553.5

(Continued)

FOREIGN PATENT DOCUMENTS

BR PI 9712549-0 A 10/1999
CN 1478004 A 2/2004

(Continued)

OTHER PUBLICATIONS

Ukranian Decision on Grant dated Sep. 11, 2014, issued in Patent Application No. 2010 13571, filed May 21, 2007 (2 pgs.) English Translation.

(Continued)

*Primary Examiner* — Scott Kastler
(74) *Attorney, Agent, or Firm* — Nixon & Vanderhye P.C.

(57) ABSTRACT

Nozzle for guiding molten metal flowing from a vessel into a mold, the nozzle having a conduit which is elongate along an axis which is orientated vertically during use. The nozzle has at least one upper inlet and at least two lower outlets with a flow divider disposed therebeween. Opposite sides of the flow divider define a lower wall of each lower outlet, and a recessed channel is provided in each of the opposite sides of the flow divider so as to produce fluid flow which closely follows the shape of the lower outlets.

6 Claims, 4 Drawing Sheets

(56) References Cited

U.S. PATENT DOCUMENTS

Figure 1:
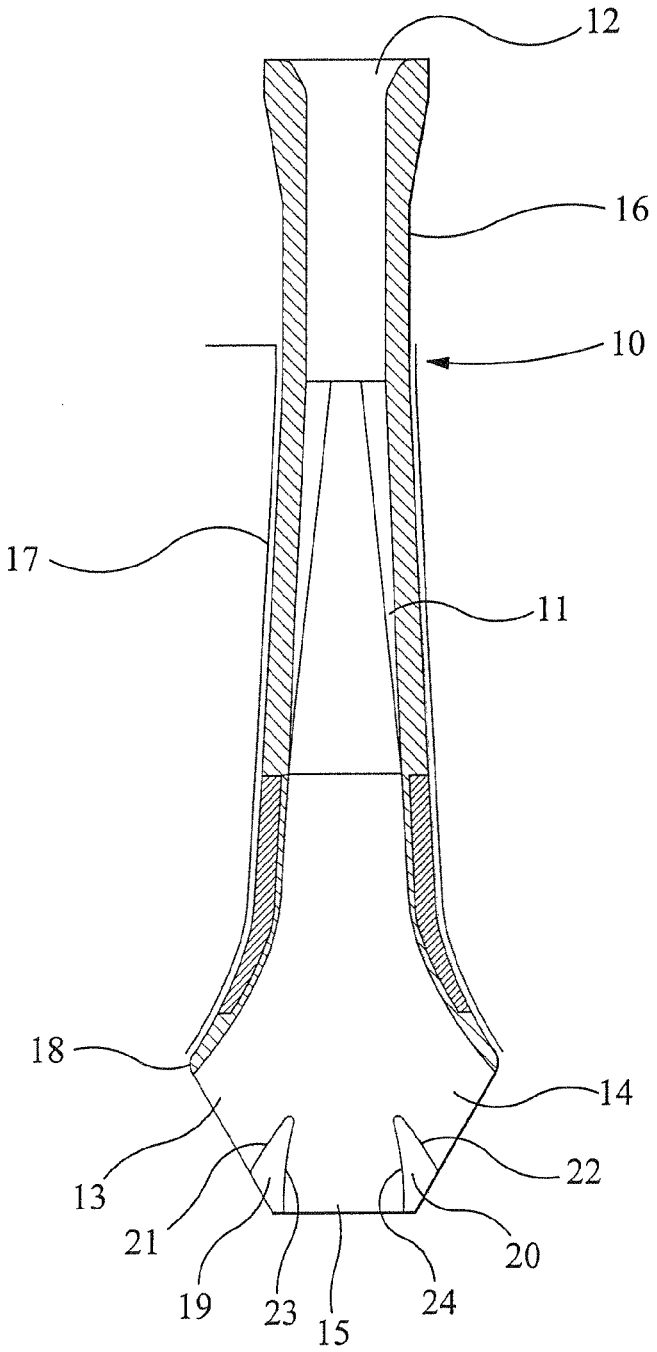

| | | | | |
|---|---|---|---|---|
| 6,464,154 | B1 | 10/2002 | Heaslip et al. | |
| 7,363,959 | B2 * | 4/2008 | Hanna et al. | 164/488 |
| 8,584,911 | B2 * | 11/2013 | Morales et al. | 222/606 |
| 2006/0243760 | A1 * | 11/2006 | McIntosh et al. | 222/606 |

FOREIGN PATENT DOCUMENTS

| | | | |
|---|---|---|---|
| CN | 1478004 | A | 2/2004 |
| CN | 1671497 | A | 9/2005 |
| CN | 1671497 | A | 9/2005 |
| CN | 2784106 | Y | 5/2006 |
| CN | 2784106 | Y | 5/2006 |
| DE | 43 19 195 | A1 | 12/1994 |
| DE | 4319195 | A1 | 12/1994 |
| DE | 102 40 491 | A1 | 1/2004 |
| EP | 0 201 139 | A | 11/1986 |
| EP | 0 694 359 | A1 | 1/1996 |
| EP | 1 541 258 | A1 | 6/2005 |
| EP | 2 226 141 | A3 | 10/2010 |
| EP | 2 021 139 | B1 | 10/2012 |
| EP | 2 226 141 | B1 | 10/2012 |
| GB | 0610809.6 | | 6/2006 |
| JP | 62-089566 | A | 4/1987 |
| JP | 6289566 | A | 4/1987 |
| JP | S 62-89566 | A | 4/1987 |
| JP | 6289566 | A2 | 10/1994 |
| RU | 599915 | | 3/1978 |
| RU | 2 098 223 | C1 | 12/1997 |
| RU | 2098223 | C1 | 12/1997 |
| SU | 709 244 | A1 | 1/1980 |
| SU | 1787669 | A1 | 1/1993 |
| UA | 26335 | C1 | 8/1999 |
| UA | 41997 | C2 | 10/2001 |
| UA | 8 787 | U | 8/2005 |
| UA | 8787 | U | 8/2005 |
| UA | 200508787 | | 11/2005 |
| UA | 26 335 | U | 9/2007 |
| UA | 41997 | U | 6/2009 |
| WO | WO 01/66286 | A1 | 9/2001 |
| WO | WO 02/43904 | A1 | 6/2002 |
| WO | WO 2004/082871 | A1 | 9/2004 |
| WO | WO 2005/053878 | A2 | 6/2005 |
| WO | WO 2007/138260 | A2 | 12/2007 |

OTHER PUBLICATIONS

Brazilian Technical Examination Report; Application No. PI0713134-8, PCT No. GB2007/001878, dated Oct. 23, 2013 (3pgs).

Chinese Text of First Office Action; Application No. 201010260774X, dated Mar. 5, 2012 (3 pgs).

European Search Report; European Application No. 10003826.4, dated Sep. 28, 2010 (6 pgs).

Letter dated Jul. 16, 2012 (6 pgs); Mexican Office Action dated Jun. 12, 2012, Mexican Patent Application No. MX/a/2008/015194 (3 pgs).

Letter dated Apr. 18, 2013 (3 pgs); Mexican Office Action dated Apr. 3, 2013, Mexican Patent Application No. MX/a/2012/006184 (2pgs).

Malaysian Substantive Examination Adverse Report dated May 31, 2013, Malaysian Patent Application No. PI 20084784 (2 pgs), Search Report dated Apr. 25, 2013 (1 pg).

TIPO's Search Report for Taiwan Patent Application No. 096119421 dated Nov. 6, 2012.

PCT Invitation to Pay Additional Fees dated Sep. 18, 2007, International Application No. PCT/GB2007/001878, International Filing Date May 21, 2007 (6 pgs).

State Intellectual Property Office, P.R. China, First Office Action, Search Report, issued Sep. 9, 2010, Patent Application No. 200780020297.6, filed May 21, 2007, (8 pgs).

European Search Report dated Sep. 28, 2010, Application No. 10003826.4-1215/2226141 (6 pgs).

Australian Examiner's First Report w/Search Report on Patent Application No. 2007266846, dated Sep. 28, 2010 (2 pgs).

Canadian Patent Application No. 2,652,987, Office Action dated Oct. 29, 2012, 2 pgs.

Malaysian Patent Application No. PI 20084784, Office Action dated May 31, 2013, 3 pgs.

TIPO's Search Report for Taiwan Patent Application No. 096119421, dated Nov. 6, 2012 (1 pg).

Mexican Patent Application No. 52945, Office Action dated Jun. 12, 2012, 8 pgs.

* cited by examiner

CASTING NOZZLE

This application is a divisional of patent application Ser. No. 11/886,478 filed Sep. 29, 2008, U.S. Pat. No. 8,584,911, which is a 371 of PCT/GB2007/001878, filed May 21, 2007, which claims priority to British Patent Application No. 610809.6 filed Jun. 1, 2006, the entire contents of each of which are hereby incorporated by reference.

The present invention relates to a nozzle for guiding molten metal, for example molten steel. More particularly the invention relates to a so-called submerged entry nozzle, sometimes known as a casting nozzle, used in the continuous casting process for producing steel. The invention also relates to the use of the nozzle when casting steel.

In the continuous casting of steel, molten steel from a ladle is poured into a large vessel known as a tundish. The tundish has one or more outlets through which the molten steel flows into one or more respective moulds in which the molten steel cools and solidifies to form continuously cast solid lengths of the metal. The casting nozzle or submerged entry nozzle is located between the tundish and each mould, and guides molten steel flowing through it from the tundish to the mould(s). The casting nozzle is generally in the form of an elongated conduit, i.e. a rigid pipe or tube.

The main functions of such a casting nozzle are as follows. Firstly the nozzle serves to prevent the molten steel from coming into contact with air as it flows from the tundish into the mould, since air would cause oxidation of the steel, which is undesirable. Secondly, it is highly desirable for the nozzle to introduce the molten steel into the mould in as smooth and non-turbulent a manner as possible, since turbulence in the mould causes the flux on the surface of the molten steel in the mould to become dragged down into the steel (known as "entrainment"), thereby generating impurities in the cast steel. Turbulence in the mould also disrupts the lubrication of the sides of the mould. One of the functions of the mould flux (apart from preventing the surface of the steel from coming into contact with air) is to lubricate the sides of the mould to prevent the steel adhering to and solidifying again. The flux also helps to prevent the consequent formation of surface defects in the cast steel. Minimizing the turbulence by means of the submerged entry nozzle is therefore important for this purpose also. Additionally, turbulence can cause stress on the mould itself, risking damage to the mould. Furthermore, turbulence in the mould can also cause uneven heat distribution in the mould, consequently causing uneven solidification of the steel and also causing variations in the quality and composition of the steel being cast. This latter problem also relates to a third main function of the submerged entry nozzle, which is to introduce the molten steel into the mould in an even manner, in order to achieve even solidified shell formation (the steel solidifies most quickly in the regions closest to the mould walls) and even quality and composition of the cast steel. A fourth function of an ideal submerged entry nozzle is to reduce or eliminate the occurrence of oscillations in the standing wave in the meniscus of steel in the mould. The introduction of molten steel into the mould generally creates a standing wave at the surface of the steel, and any irregularities or oscillations in the flow of the steel entering the mould can give rise to oscillations in the standing wave. Such oscillations can have a similar effect to turbulence in the mould, causing entrainment of mould flux into the steel being cast, disrupting the effective lubrication of the sides of the mould by the mould flux, and adversely affecting the heat distribution in the mould.

It will be appreciated that designing and manufacturing a submerged entry nozzle which performs all of the above functions as well as possible is an extremely challenging task. Not only must the nozzle be designed and manufactured to withstand the forces and temperatures associated with fast flowing molten steel, but the need for turbulence suppression combined with the need for even distribution of the molten steel in the mould create extremely complex problems for fluid dynamics.

In our International Patent Application WO02/43904 there is disclosed a submerged entry nozzle which has two lower side outlets inclined to a central axis of the conduit through the nozzle. Between the discharge outlets is a structure defining a receptacle and, with a divider, defining two lower outlets. The opposite inner side walls respectively of the lower outlets are downwardly divergent.

An object of the present invention is to provide a casting nozzle which has an improved performance compared to said above mentioned prior art nozzle.

According to a first aspect of the present invention there is provided a nozzle for guiding molten metal flowing from a vessel into a mould, the nozzle comprising a conduit which is elongate along an axis which is orientated vertically during use, the nozzle having at least one upper inlet and at its lower end having two spaced apart baffles, the respective outer walls of the baffles partly defining two lower outlets and the respective inner walls of the baffles defining at least part of at least one outlet flow passage therebetween and each inner wall being at least partly concavely curved and arranged so that there is converging flow from said outlet flow passage or passages.

The lower outlets are preferably inclined to said axis at an angle, more preferably at <90°.

Preferably the baffles both extend from level of the extremity of the nozzle.

Desirably the respective outer walls of the baffles are convexly curved.

Conveniently at least one flow divider or splitter is disposed between said spaced apart baffles. In one embodiment a single flow divider is provided, centrally between the baffles, and the respective opposite sides of the flow divider are straight, relatively diverging towards the extremity of the nozzle. Advantageously the flow divider extends from the level of said extremity.

The height of the flow divider can be such that it terminates below the level to which the baffles extend, but preferably it is particularly advantageous if the flow divider extends above the level to which the baffles extend. This causes the molten metal to exit the nozzle occupying the full port area, and can provide an improvement of 15-20% over the arrangement where said shorter flow divider is used.

More preferably, with the flow divider terminating either above or below the upper level of the baffles, a perturbation may be provided therein. This could be in the form of a continuous vertical channel in one or both walls of the flow divider facing the baffles. Alternatively the perturbation could be a discontinuous channel, slot, dimple, protruberance, groove, cut-out or any discontinuity in one or both walls of the flow divider facing the baffles. Where the perturbation is a recessed feature such as a cut-out or slot provided in both walls, the perturbation may meet to define a passage or bore through the flow divider.

With the respective continuous channels in these walls, it has been found that the boundary layer is altered, producing fluid flow which much more closely follows the shape of the port.

Moreover instead of, or in addition to providing such perturbations in the flow divider(s), the perturbations could be provided in one or both of the facing inner walls of the baffles, and even perhaps in one or both of said outer walls of the baffles.

According to another aspect of the present invention there is provided a nozzle for guiding molten metal flowing from a vessel into a mould, the nozzle comprising a conduit which is elongate along an axis which is orientated vertically during use, the nozzle having at least one upper inlet and at least one lower side outlet, at least one of any surfaces of the nozzle at or below the level of the uppermost lower side outlet, which are adapted to direct molten metal, in use, having one or more perturbations provided therein.

From the above, it will be understood that where baffles are provided, the perturbations can be in the inner and/or outer wall of the baffles. Where a flow divider is provided, the perturbations can be in one or both of the opposite side walls of the divider. The divider may be used without baffles, but where they are provided, the divider can terminate above or below the upper level thereof.

The perturbations can be provided in the wall of the or all lower side outlet(s) and where the lower side outlet has its lower wall defined by a wall of a baffle or a divider, this lower wall can be formed with the perturbations. The upper wall of the lower side outlet can alternatively be formed with said perturbations additionally or instead of said lower wall thereof.

The perturbations may be as with said first aspect, i.e. channels (continuous or discontinuous), slots, grooves, cut-outs, dimples, protruberances or any other discontinuity.

The perturbations may thus be provided in any surface at or below the level of the uppermost side outlet of the nozzle, i.e. excluding perturbations in the central flow bore above said level.

Figure 2:
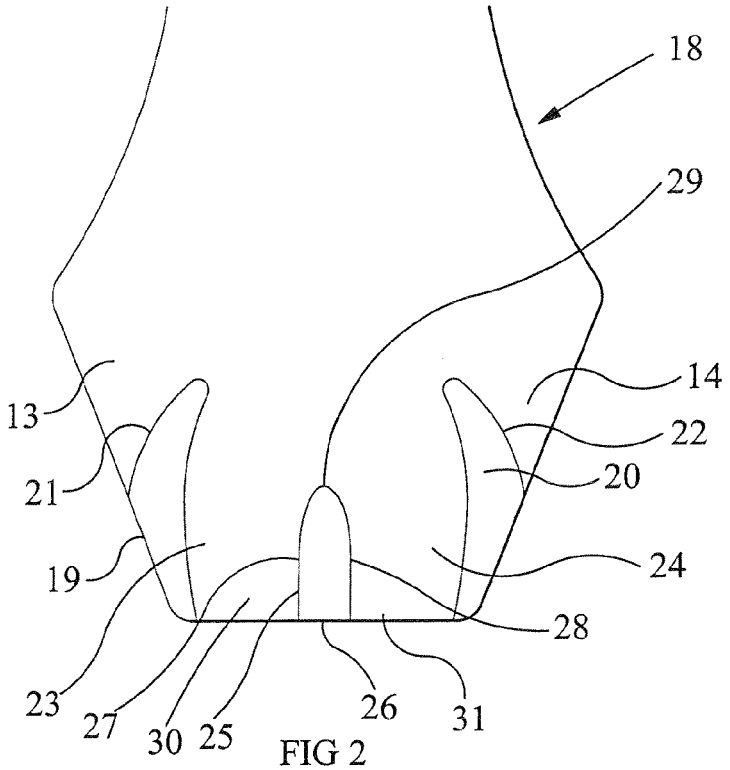
Figure 3:
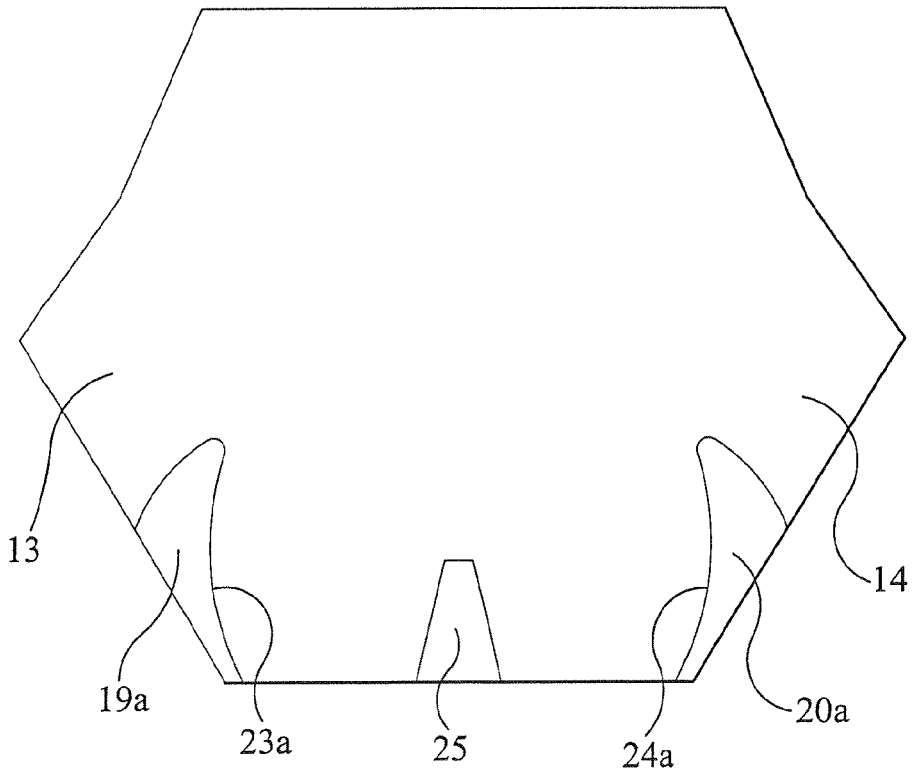

The invention will now be described, by way of example, with reference to the accompanying drawings, in which:

FIG. 1 is a longitudinal cross-sectional view of a casting nozzle of one embodiment of the present invention, FIG. 2 is a fragmentary view of a second embodiment of a casting nozzle, including a central flow divider, FIG. 3 is a fragmentary view of a third embodiment of a casting nozzle similar to that shown in FIG. 2, but to a larger scale.

Figure 4:
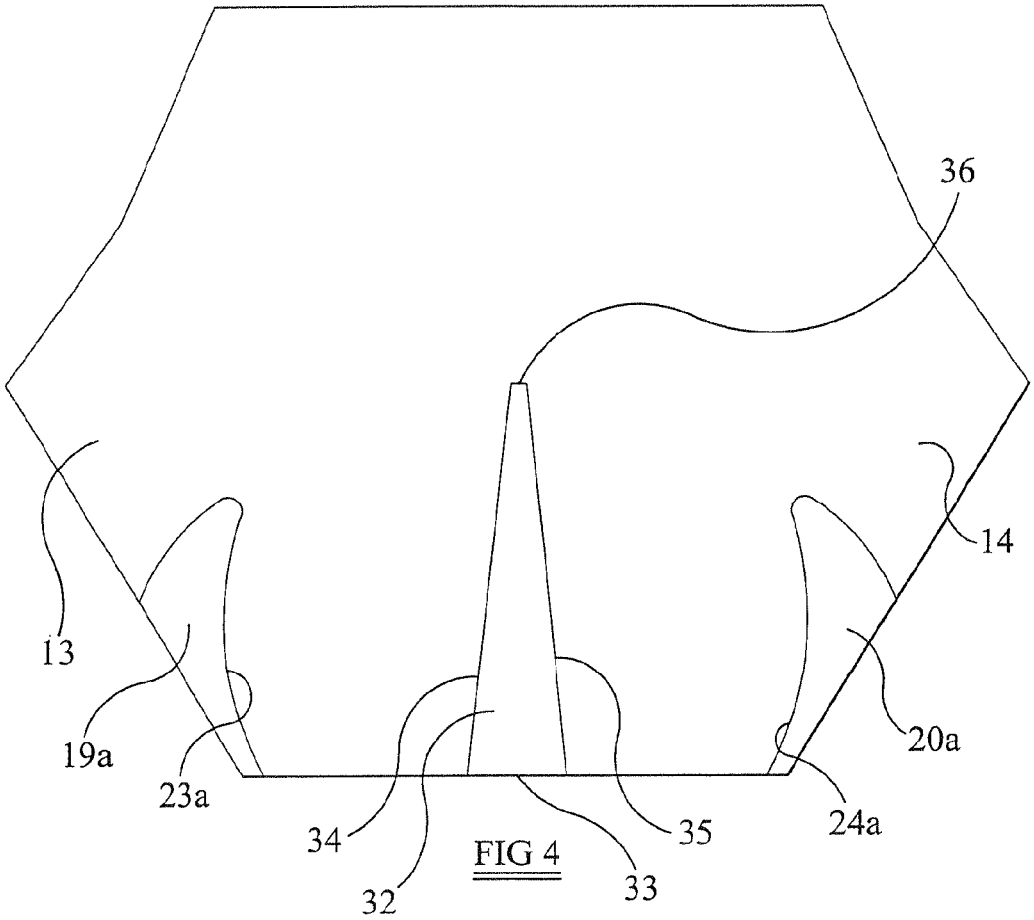
Figure 5:
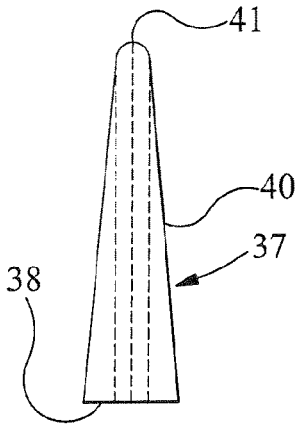
Figure 6:
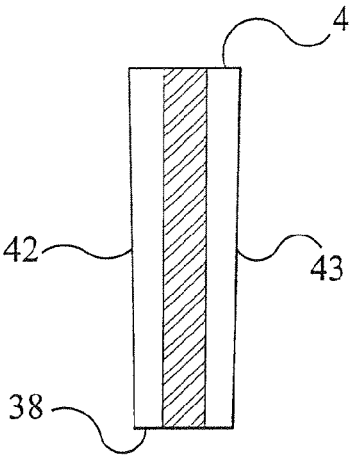
Figure 7:
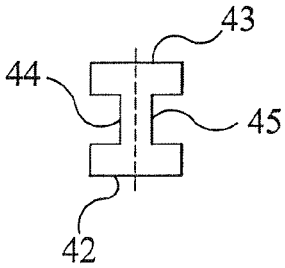
Figures 8, 9, 10:
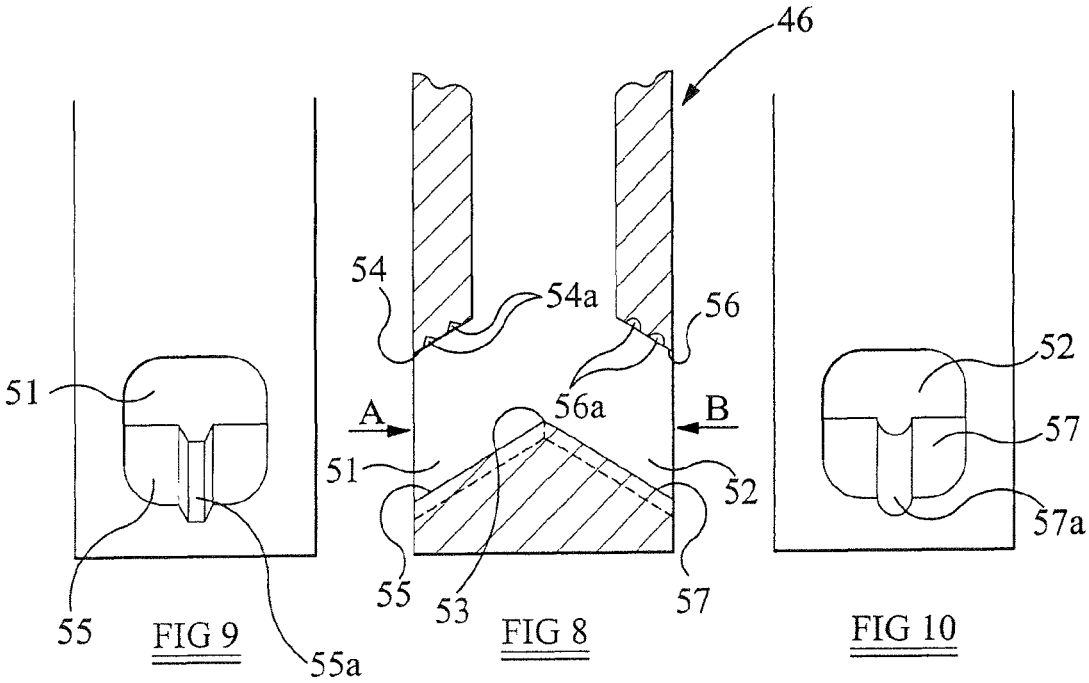

FIG. 4 is a fragmentary view, like FIG. 3, of a fourth embodiment of casting nozzle, FIGS. 5 to 7 are respectively a front view, a side view and a lower end view of a further form of the flow divider shown in FIG. 4, FIG. 8 shows schematically a casting nozzle of another aspect of the invention with examples of reliefs in surfaces thereof, and FIGS. 9 and 10 are views on the arrows A and B respectively of FIG. 8.

FIG. 1 shows a nozzle 10 according to one embodiment of the invention, the nozzle comprising a conduit 11 which is elongate along an axis which is oriented substantially vertically during use. The nozzle has an upper inlet 12, two lower outlets 13, 14 which are inclined to the axis, and a lower outlet 15 which is located generally axially between the inclined lower outlets 13, 14.

The nozzle 10 comprises, in essence, three sections. An upper section 16 of the nozzle has the form of a substantially circular cross-section tube, terminating at its uppermost extremity in the inlet 12. Below the upper section 16, a middle section 17 is flared outwardly in one plane parallel to the nozzle axis, and flattened in an orthogonal plane. Below the middle section 17 is a lower section 18, comprising the inclined outlets 13, 14 and the axial outlet 15.

Like the middle section 17, the lower section 18 is flattened in said orthogonal plane and is also flared outwardly. Two baffles 19, 20 respectively are formed at the opposite sides of the extremity of the nozzle, the baffles extending fully across the width of the conduit in the direction of said orthogonal plane.

According as will be seen from FIG. 1, the inclined outlets 13, 14 are respectively defined between the flared side walls of the nozzle in said lower section 18 and respective outer walls 21, 22 of the baffles 19, 20. In the example shown in FIG. 1, these outer walls are convexly curved down to the respective open ends of the outlets 13, 14 from where these outer walls of the baffles are straight, extending as side walls of the nozzle down to the nozzle lower extremity, at which the baffles terminate. As can be seen from FIG. 1, the baffles are formed with respective inner walls 23, 24, which are concavely curved, each inner wall extending from the lower extremity of the baffle up to its curved tip at which the concave outer wall of the baffle terminates. As shown in FIG. 1, the tip is radiussed, but in another embodiment this tip could be formed as a sharp apex, or a flat surface. The lower axial inlet 15 is thus defined between the respective facing inner walls 23, 24 of the baffles 19, 20.

In use, the casting nozzle 10 of FIG. 1 is arranged between a tundish and a mould and serves to guide molten steel flowing through it from the tundish to the mould. Thus steel enters the upper inlet 12 and flows downwardly through the upper section 16 and middle section 17 of the nozzle. When the steel stream reaches the lower section 18, it encounters the baffles 19, 20, initially the upper tips thereof, and as a result steel flows out through the inclined outlets 13, 14 respectively, with the remainder of the stream discharging from the lower extremity of the nozzle through the lower axial outlet 15 defined between the respective inner walls 23, 24 of the baffles 19, 20. Since these inner walls are convexly curved and arranged as shown in FIG. 1, the steel is 'compressed', such that steel leaving the casting nozzle and entering the mould is not diffused, as would be the case if, for example, the lower inner surfaces of the baffles relatively converged.

As far as the precise position and arrangement of each baffle is concerned, it is clearly desirable that these are the same, i.e. that there is a symmetrical configuration to this lower section 18. It can be seen that in the embodiment shown in FIG. 1, the lower extremity of the inner wall of the baffle is spaced slightly outwardly of the upper extremity of the inner wall, i.e. the upper extremity at said tip, so that the distance between the respective upper extremities of the baffles is less than the distance between the lower extremities of the baffles, these distances being measured from the respective inner walls of the baffles. However it will be understood that the more important factor influencing the outflow of the metal stream is the fact that the inner walls are concavely curved. It will however be understood that this concave curvature need not extend over the whole of each inner wall, so that the concave curvature could be for only part of said wall in each case.

Turning now to FIG. 2, this shows, schematically, the lower section of a further form of casting nozzle according to the present invention. It is, however, very similar to the lower section shown in FIG. 1, and common parts will be denoted by the same numerals as used in FIG. 1. Accordingly it can be seen that the embodiment shown in FIG. 2 has baffles 19, 20 arranged identically to the FIG. 1 embodiment with respective inclined outlets 13, 14 being disposed above the outer walls 21, 22 of said baffles. Indeed the only change from the lower section 18 shown in FIG. 1, is that between the baffles 19, 20, extending upwardly from the level of the lower extremity of the nozzle is a central flow divider 25. The flow divider 25, like the baffles 19, 20, extends fully across the width of the conduit. The flow divider has a flat lower surface 26 disposed at the level of the extremity of the nozzle, whilst its substantially straight opposite side walls 27, 28 respectively upwardly converge to form a radiussed upper tip 29. The central longitudinal axis of the nozzle extends through the centre of said flow divider which is thus centrally axially positioned mid-way between the respective inner walls 23, 24 of the baffles. Accordingly two equal generally axial outlets 30, 31 respectively are formed at the respective opposite sides of the flow divider, the outlet 30 being defined between the baffle inner wall 23 and the side wall 27 of the divider, whilst the axial outlet 31 is formed between the inner wall 24 of the baffle 20 and the side wall 28 of the flow divider.

Like the arrangement shown in FIG. 1, there is 'compression' of the flowing steel by virtue of the concavely curved inner walls 23, 24 of the baffles, so that with this provision of the central divider, the flows exiting the axial outlets 30, 31 are themselves so 'compressed' and converged.

FIG. 3 shows a still further embodiment of the invention, this Figure being very similar to that shown in FIG. 2, in illustrating only the lower section 18 of the casting nozzle. Again identical reference numerals have been used for identical parts. In fact the only difference from the arrangement shown in FIG. 2 relates to the configuration of the baffles, denoted here by the reference numerals 19*a*, 20*a*. As can be seen from FIG. 3, whilst the respective inner walls 23*a*, 24*a* of the baffles are still concavely curved, they are effectively more 'tipped' back relative to the longitudinal centre line through the nozzle, so that in contrast to the arrangement of the first and second embodiments where the distance between the upper tips is less than the distance between the respective lower extremities of the inner walls 23, 24, the opposite is true with the FIG. 3 embodiment, namely that the distance between the respective upper extremities of the inner walls 23*a*, 24*a* is greater than the distance between the respective lower extremities of the inner walls 23*a*, 24*a*. It could be seen that this is due to the fact that a line parallel to the longitudinal centre line of the nozzle taken through the lower extremity of an inner wall of the baffle is inwards of a corresponding line taken through the upper extremity of the inner wall of the baffle. However it is believed that this arrangement would similarly provide the benefits referred to in relation to the first and second embodiments in FIGS. 1 and 2 respectively.

With the embodiments so far described, it will be noted that where a central flow divider is provided, it extends upwardly from the extremity of the conduit to a level which is significantly below the level at which the respective tips of the baffles are disposed. However in the embodiment shown in FIG. 4, which is otherwise identical with that shown in FIG. 3, the central flow divider, now denoted by the numeral 32, extends well above the level at which the respective tips of the baffles are disposed. The central flow divider 32 has a lower flat base 33 substantially at the level of the extremity of a conduit 11 and straight upwardly converging opposite side walls 34, 35 respectively, these side walls meeting at an upper flat 'tip' 36.

The provision of this central flow divider 32 has been found to control the boundary layer and typically it can be of the order of 1 cm above the top of the baffles. This design causes the molten steel to exit the nozzle occupying the full outlet area and it is believed that this provides an improvement over the design shown in FIGS. 2 and 3 respectively.

FIGS. 5 to 7 show another form of central flow divider, denoted by the numeral 37. Although primarily it is intended that this flow divider 37 would replace the flow divider 32, i.e. it would extend above the upper level of the baffles in the casting nozzle, it could if required replace a flow divider such as the flow divider 25 which only extends to a level below the upper level of the baffles. The flow divider 37 is of similar form to the flow divider 32, in having a flat base 38 and opposite, converging side walls 39, 40 respectively, the top junction of these side walls being radiussed as at 41, to form the tip of the flow divider. From the side view shown in FIG. 6, it can be seen that in the embodiment illustrated the front and rear sides 42, 43 respectively diverge upwardly from the base 38 so that the width of the tip is greater than the width of the base, as shown. From FIG. 7 it can be seen that perturbations in the form of central rectangular channels 44, 45 are formed respectively in the side wall 39, 40, these channels extending for the full height of the divider. By providing these channels, the boundary layer is altered, making the fluid flow follow the shape of the outlets much more closely.

Instead of the perturbations being in the form of a continuous vertical channel in one or both side walls of the flow divider facing the baffles, the perturbation could be a discontinuous channel, slots, grooves, cut-outs or any other discontinuity in one or both walls of the flow divider facing the baffles. In particular the cross-section of the perturbation might not be rectangular as shown and instead, for example, the perturbation could merely be recessed 'dimples'. Moreover instead of, or in addition to providing such perturbations in the flow divider(s), the perturbations could be provided in one or both of the facing inner walls of the baffles. As far as the respective outer walls of the baffles are concerned, these need not necessarily be of convex curved form, in that they could be straight, or indeed of any other suitable form. Moreover it is also possible that in one or both of said outer walls of the baffles discontinuities such as those referred to in relation to the flow divider 37, could be provided in said walls.

With all the embodiments of the present invention, converging flow is produced out of the lower port or ports (outlets). By mathematical modelling, it has been demonstrated that the present invention produces a converging outflow. In particular by examining pathlines in the mould a nozzle of the present invention converges the fluid flow such that the stream remains concentrated deeper into the mould until swirling flow patterns can be noted. With casting nozzles known from the prior art, the intention is to diffuse the stream, so that the equivalent pathlines demonstrate a spreading and diffusing of the fluid flow from the lower port(s).

Instead of the perturbations being provided in conjunction with the concavely curved inner walls of the baffles of the nozzle, the relief or reliefs may be provided in any surface of the nozzle which is adapted, in use, to direct molten metal flowing through the nozzle, provided such surface is at or below the level of the uppermost lower side outlet. Surfaces in the central flow bore above the uppermost lower side outlet are thus not relevant to this further inventive aspect.

FIG. 8 shows the lower end of a form of alternative (2 port) casting nozzle 46, with perturbations of various forms in the four 'directing' flow surfaces shown, namely 47 to 50 inclusive.

The casting nozzle has a pair of oppositely directed, downwardly sloping side outlets 51, 52. The bottom of the internal structure of the nozzle is formed as a part-conical surface with its tip 53 on the central axis of the nozzle. Accordingly each outlet has its upper surface defined by the lower end of the nozzle wall defining the central flow passage and its lower surface defined by a sloping surface of the internal conical structure at the bottom of the nozzle. The outlet 51 has its upper and lower surfaces denoted by 54, 55 respectively, whilst for outlet 52 the numerals 56, 57 respectively are used equivalently.

As shown in FIGS. 8 and 9, the surface 54 is provided with perturbations in the form of V-grooves 54*a*, whilst the surface 56 is provided with concave dimples 56*a*. The lower surface of outlet 51 at its surface 55 is formed with a V-groove 55*a* flattered at its inner base, whilst the surface 57 of outlet 52 is formed with a semi-circular section groove 57*a*. These are just examples of the types of perturbation/discontinuities and examples of the flow directing surfaces of the nozzle to which they may be applied. As mentioned previously, the provision of the perturbations alters the boundary layer, producing fluid flow which much more closely follows the port shape. Port utilisation is thus improved and the kinetic energy of the molten metal stream is dispersed inside the nozzle as opposed to outside it by reduction of the boundary condition affects.

The invention claimed is:

1. A nozzle for guiding molten metal flowing from a vessel into a mould, the nozzle comprising a conduit which is elongate along an axis which is orientated vertically during use, the nozzle having at least one upper inlet and at least two lower outlets with a flow divider disposed therebeween, opposite sides of said flow divider defining a lower wall of each lower outlet, wherein a recessed channel is provided in each of the opposite sides of the flow divider so as to produce fluid flow which closely follows the shape of the lower outlets.

2. A nozzle as claimed in claim 1, wherein a recessed channel is provided in an upper wall of the or all lower outlets.

3. A nozzle as claimed in claim 2, wherein the recessed channel extends substantially along the whole length of the upper wall of the or all lower outlets.

4. A nozzle as claimed in claim 1, wherein each recessed channel extends substantially along the whole length of the respective opposite sides of the flow divider.

5. A nozzle as claimed in claim 1, wherein each recessed channel is orientated substantially vertically.

6. A nozzle as claimed in claim 1, wherein each recessed channel is orientated parallel to a central axis of the respective lower outlet.

* * * * *